US009629229B2

(12) United States Patent
Kinderman et al.

(10) Patent No.: US 9,629,229 B2
(45) Date of Patent: Apr. 18, 2017

(54) CONNECTABLE AND SYNCHRONIZABLE LIGHT STRINGS

(71) Applicant: J. Kinderman & Sons, Inc., Philadelphia, PA (US)

(72) Inventors: Israel Richard Kinderman, Philadelphia, PA (US); David Wong, Hung Hom (HK)

(73) Assignee: J. Kinderman & Sons, Inc., Philadelphia, PA (US)

( * ) Notice: Subject to any disclaimer, the term of this patent is extended or adjusted under 35 U.S.C. 154(b) by 0 days.

(21) Appl. No.: 14/804,863

(22) Filed: Jul. 21, 2015

(65) Prior Publication Data

US 2016/0021724 A1 Jan. 21, 2016

Related U.S. Application Data

(60) Provisional application No. 62/027,213, filed on Jul. 21, 2014.

(51) Int. Cl.

| | |
|---|---|
| ***H05B 37/02*** | (2006.01) |
| ***H05B 33/08*** | (2006.01) |
| ***F21V 23/04*** | (2006.01) |
| ***F21V 23/00*** | (2015.01) |
| ***F21S 4/00*** | (2016.01) |
| ***F21V 23/06*** | (2006.01) |
| ***F21S 4/10*** | (2016.01) |
| *F21Y 101/00* | (2016.01) |

(52) U.S. Cl.

CPC ..... *H05B 37/0281* (2013.01); *F21S 4/10* (2016.01); *H05B 33/0809* (2013.01); *H05B 33/0827* (2013.01); *H05B 33/0842* (2013.01); *H05B 37/029* (2013.01); *H05B 37/0272* (2013.01); *F21Y 2101/00* (2013.01)

(58) Field of Classification Search

None

See application file for complete search history.

(56) References Cited

U.S. PATENT DOCUMENTS

| | | | | |
|---|---|---|---|---|
| 4,675,575 | A * | 6/1987 | Smith | F21S 4/10 250/552 |
| 5,028,844 | A | 7/1991 | Sakaguchi et al. | |
| 5,691,578 | A | 11/1997 | Driska | |
| 6,031,343 | A * | 2/2000 | Recknagel | A63D 1/08 315/292 |
| 6,072,280 | A * | 6/2000 | Allen | H05B 33/0806 315/185 S |
| 6,140,620 | A | 10/2000 | Aldridge et al. | |

(Continued)

*Primary Examiner* — Crystal L Hammond

(74) *Attorney, Agent, or Firm* — Panitch Schwarze Belisario & Nadel LLP

(57) ABSTRACT

Embodiments of the present disclosure include a decorative light string including a first light strand, a power supply, a controller, and an electrical connector. The first light strand includes a plurality of parallel connected light emitting elements. The power supply is configured to convert alternating current (AC) line power to direct voltage (DC) voltage power to power the first light strand. The controller is operatively coupled to the first light strand and the power supply. The controller is configured to control the plurality of light emitting elements. The electrical connector couples a first light strand to a second decorative light string via the AC line power.

22 Claims, 4 Drawing Sheets

(56) References Cited

U.S. PATENT DOCUMENTS

| | | | | |
|---|---|---|---|---|
| 6,165,037 | A | 12/2000 | Van Zant | |
| 7,175,302 | B2 | 2/2007 | Kazar et al. | |
| 7,497,588 | B2 | 3/2009 | Browder | |
| 7,508,141 | B2 | 3/2009 | Wong | |
| 7,758,234 | B1 | 7/2010 | Savicki, Jr. et al. | |
| 7,762,866 | B2 | 7/2010 | Hui | |
| 7,994,723 | B2 | 8/2011 | Budde et al. | |
| 8,013,535 | B2 | 9/2011 | Jozwik | |
| 8,115,414 | B2 * | 2/2012 | Zhao | H05B 33/0815 315/185 S |
| 8,344,659 | B2 * | 1/2013 | Shimomura | H05B 37/0245 315/169.3 |
| 8,558,508 | B2 | 10/2013 | Fechalos et al. | |
| 2002/0135315 | A1 * | 9/2002 | Puleo, Sr. | H05B 37/029 315/185 R |
| 2002/0186151 | A1 | 12/2002 | Greenberg | |
| 2003/0057886 | A1 * | 3/2003 | Lys | F21V 21/002 315/291 |
| 2003/0085625 | A1 | 5/2003 | Windgassen et al. | |
| 2007/0279811 | A1 | 12/2007 | Wang et al. | |
| 2008/0164826 | A1 * | 7/2008 | Lys | H05B 33/0824 315/250 |
| 2009/0233518 | A1 | 9/2009 | Hui | |
| 2010/0327780 | A1 | 12/2010 | Hoschopf | |
| 2011/0285299 | A1 * | 11/2011 | Kinderman | H05B 37/029 315/192 |
| 2012/0242234 | A1 * | 9/2012 | Long | H01R 13/6456 315/165 |
| 2013/0099685 | A1 * | 4/2013 | Zhang | H05B 33/0842 315/186 |
| 2013/0181622 | A1 | 7/2013 | Kinderman | |
| 2013/0313988 | A1 * | 11/2013 | McRae | H05B 37/02 315/193 |
| 2014/0049168 | A1 * | 2/2014 | Chen | F21S 4/001 315/161 |
| 2014/0077711 | A1 * | 3/2014 | McRae | H05B 33/0857 315/193 |

* cited by examiner

CONNECTABLE AND SYNCHRONIZABLE LIGHT STRINGS

CROSS-REFERENCE TO RELATED APPLICATIONS

This application claims the benefit of U.S. Provisional Patent Application No. 62/207,213, filed on Jul. 21, 2014, the entire contents of which are incorporated herein by reference in their entirety.

BACKGROUND OF THE INVENTION

Embodiments of the present invention relate to decorative light strings, and more particularly, connectable and synchronizable decorative light strings.

Decorative light strings are commonly used to produce visual effects at homes and in business locations around the holiday seasons. A light string that is bright and rich in flashing patterns will often strongly improve the holiday spirit of all who see it. Because light strings are limited in length, they are commonly connected together in series end-to-end when more decorating length is needed. Combining more strings together not only makes decorating easier, but it also makes decorating less expensive and time consuming since fewer electrical outlets and/or extension cords are required. When flashing or other patterns are desired, the light strings with controllers are required. However, when multiple light strings, with controllers, are connected in series, there will be a synchronization problem between the light strings, even when the same flashing pattern is used for each light string. The controllers simply have no feature which permits close synchronization between the light strings. Even powering the light strings simultaneously does not guarantee synchronization.

Other types of light strings allow the end user to change the pattern either with a remote control, or even have the lights flash to the beat of music. However, even with these types of light strings, when several are connected in series, the flashing patterns of the light strings are not actively synchronized, other than by happenstance, due to slight differences in the reference clock frequency at the controller of each light string. With more light strings used in a single space, regardless of whether they are connected together in series, the differences in reference clock frequencies will be exacerbated.

This synchronization problem is exacerbated when the flashing pattern is changed, because the user must go to the controller of each separate light string to change the settings individually, one at a time. Of course, when many different light strings are chained together in series, changing the settings of every single controller presents its own set of difficulties.

Series connected circuits containing lighting sources are well known especially in lighting strings and flexible lighting (Rope Lights) around the holidays when such light strings are used for decorative purposes. Typically, the lights in these lighting circuits are electrically in series rather than in parallel. One particular drawback to these types of lighting circuits is that when a lighting source is removed from the circuit, is burnt out, defective, or has a loose connection, the entire lighting circuit is rendered inoperable. Also, these typical light strings are run on 120 V AC power, which is wildly inefficient with respect to energy.

Accordingly, it is desirable to provide a light string having parallel connected light emitting elements that can be powered by low voltage DC power and allowing for the connection and synchronization of other light strings.

BRIEF SUMMARY OF THE INVENTION

In one embodiment, a decorative light string includes a plurality of parallel connected light emitting elements. A converter is configured to convert alternating current (AC) line power to direct current (DC) voltage to power the first light strand first light strand. A controller is operatively coupled to the first light strand and the converter, and includes a DC voltage output and an AC voltage output for powering a second light string. The controller is configured to control each of the plurality of light emitting elements. An electrical connecter is coupled to the first light strand and is configured to connect the second light string to the decorative light string.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used in the following description for convenience only and is not limiting. Unless specifically set forth herein, the terms "a", "an" and "the" are not limited to one element but instead should be read as meaning "at least one". The terminology includes the above-listed words, derivatives thereof and words of similar import.

Figure 1:
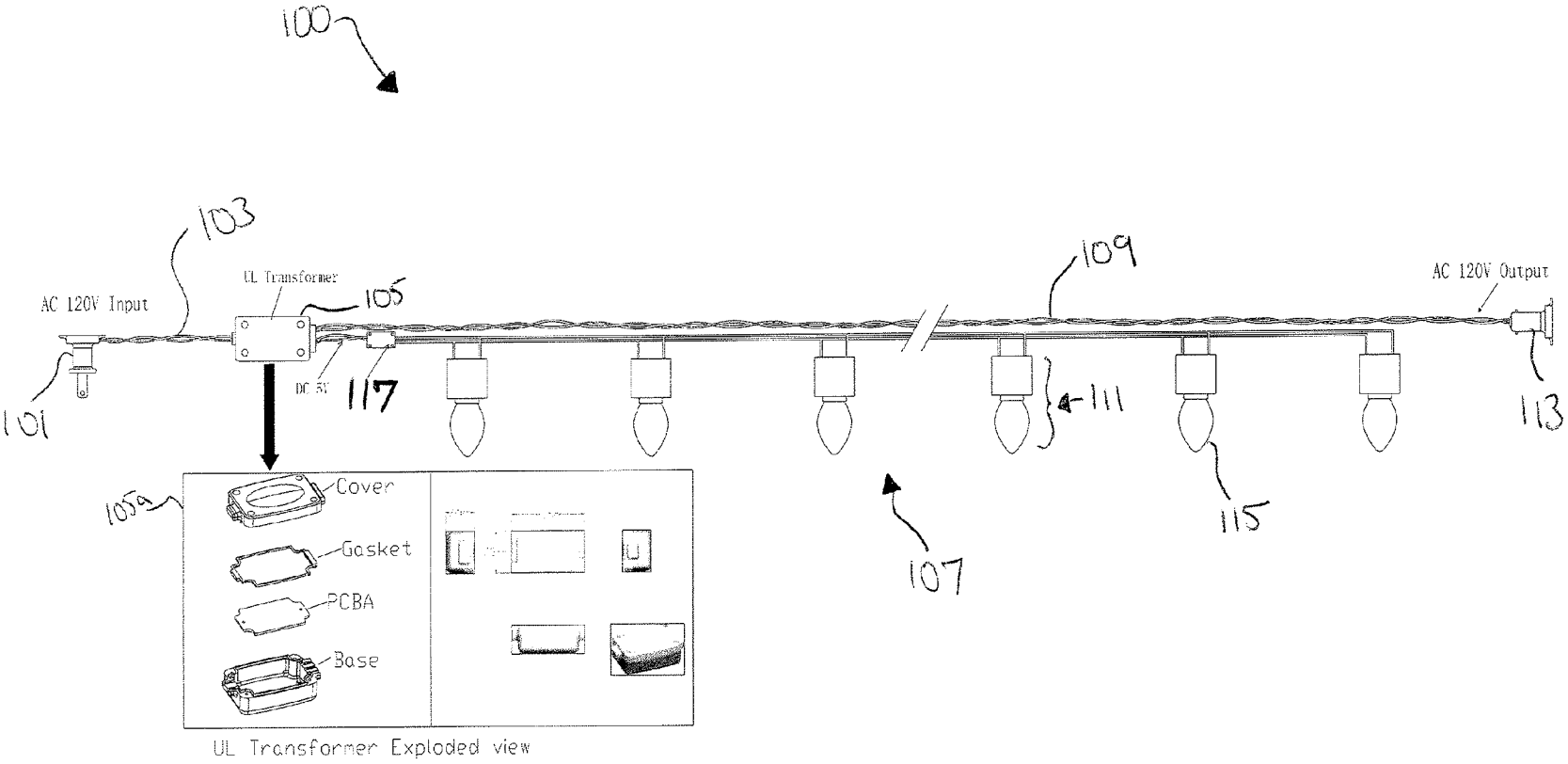
FIG. 1 is a schematic view of a decorative light string according to an embodiment of the present invention.

Turning in detail to the drawings, FIG. 1 illustrates a decorative light string 100. The decorative light string 100 receives power through a first standard electrical connector 101 affixed at the end of an electrical lead 103 extending from a control box 105 including a power supply **105*a* (e.g., transformer or switching power supply) and a controller (not shown). The power supply 105*a* converts an AC power source to DC power to power a light strand 107. Thus, for example, the power supply 105*a* may convert a voltage of about 120 volts AC into a voltage of about 5 volts DC, or the like. It should be noted that the power supply 105*a* may convert a voltage ranging from about 115 to 125V, to about 4 to about 6 V DC in keeping with the invention. In addition to powering the light strand 107 with the low DC voltage, the power supply also transmits about AC 120V on a bypass lead 109. Although as shown, the bypass lead 109 is output from the control box 105, the bypass lead 109 may be located outside the control box 105. In the normal operating mode, AC power is preferably supplied to the power source by plugging the first standard electrical connector 101** into a standard power line, such as a wall outlet receptacle (not shown), a power strip, surge protector, or the like.

The light strand 107 includes a plurality of light emitting modules 111 distributed along its length, at the end of which is a second standard electrical connector 113. The first and second electrical connectors 101 and 113 form a male-female pair to enable multiple decorative light strings to be connected. The first and second electrical connecters, 101, 113 may be but need not be polarized. For example, each may have a preferable non-polarized configuration. Because the second connector 113 is coupled to the bypass lead 109 supplying 120V AC, the known voltage for supplying other types of the light strands in the U.S., it can be appreciated that any type of decorative light string can be connected and operated according to embodiments of the present invention discussed herein.

Each of the plurality of light emitting modules includes one or more light emitting elements 115. The light emitting elements 115 may be of any appropriate type, including single LEDs, multi-LEDs, LED clusters, incandescent lamps, and the like. In the description below, even where a specific type of lighting element is referenced, those of skill in the art will recognize that other types of lighting elements may be substituted, in some cases directly, and in other cases with appropriate changes to the circuitry.

In certain retail environments, it is preferable to demonstrate functionality of a product available for sale prior to the product's purchase by the user. This way, the user is able to get a better understanding of the functionalities and capabilities of the product prior to purchasing, while the product is still in a store, such as on the store shelf. Preferably, the demonstration mode of the product is available while the product is still in its packaging. As such, the decorative light string may optionally include a demonstration module, otherwise known as a "Try Me" module 117 coupled to the light strand 107 enabling a demonstration mode of a connected product for a predetermined period of time when engaged. The "Try Me" module may take the form of the Try Me module discussed in U.S. Patent Application Publication No. 2013/0181622 A1, the entire contents of which are incorporated herein by reference in their entirety.

Figure 2:
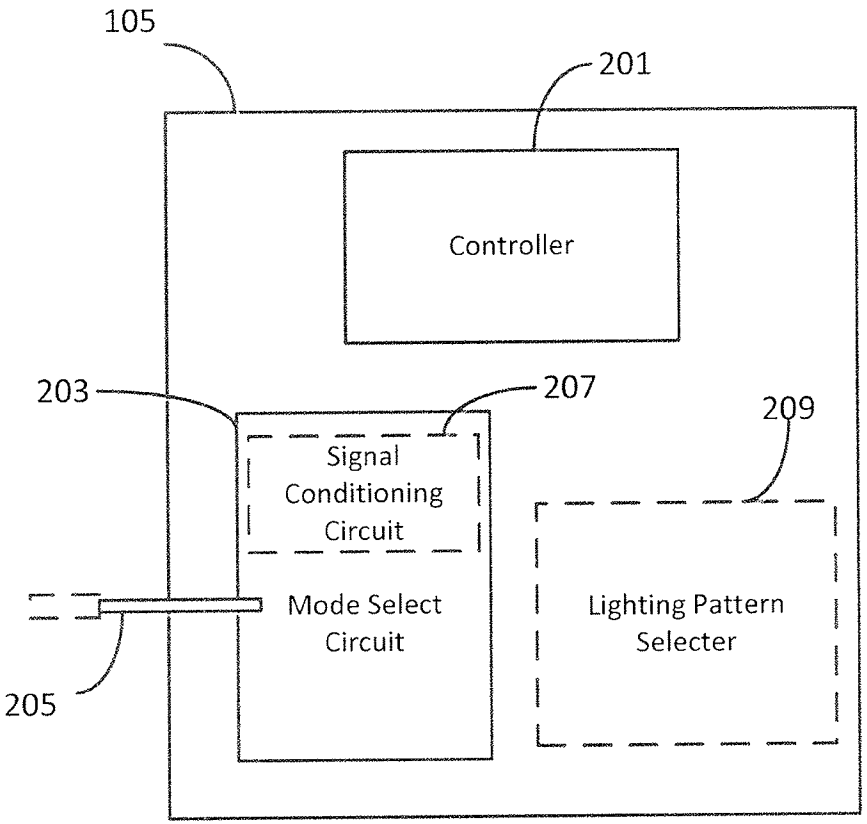
FIG. 2 is a schematic diagram of components of a control box according to an embodiment of the present invention.

Referring now to FIG. 2, a control box 105, of a first light string, houses a controller 201 and a mode select circuit 203, any of which can may be combined into a single circuit as a matter of design choice. The controller 201, which may take the form of an integrated circuit (IC) may operate in either a master mode or a slave mode. In the master mode, the controller 201 controls the scheme and/or flashing pattern of the light emitting elements 115. In the slave mode, the controller 201 controls the scheme and/or flashing pattern of the lighting elements according to a control signal from the mode select circuit 203, the control signal being received from a second decorative light string (not shown). As described herein, the second decorative light string may refer to an additional decorative light string which may be connected to the first decorative light string 100. The second decorative light string may be the same type of decorative light string described according to embodiments of the present invention. Alternatively, as discussed above, because the above discussed power supply also transmits AC 120V through a bypass lead 109, the second decorative string can be of a different type than the first decorative string. For example, the second decorative string may be any decorative light string capable of being powered by 120 V AC or 5 V DC, inclusive of light strings of different manufacturers. It should be noted that the second decorative string may be powered by 120 V AC or any voltage ranging between about 115 V-about 125 V in keeping with the invention. Further, it should be noted that second decorative string may be powered by any low voltage DC signal (e.g., about 4-about 6 V) in keeping with the invention. It should also be noted that any number of additional strings may be connected to the first light string in keeping with the invention.

The mode select circuit 203 includes a synchronization lead 205 for connecting one decorative light string to another (e.g., the first light string to the second decorative light string), and this lead is configured to receive the control signal from the second light string. The synchronization lead 205 may include a light sensor 206 optically coupled to a light emitting element 115 of the second decorative light string for synchronization of the first decorative light string to the second light string. For example, the light sensor 206 receives the control signal by being optically coupled to the last lighting element of a first, or preceding decorative light string. With this configuration, the light sensor 206 may generate the control signal based upon the on/off sequence of or the color displayed by the last light emitting element. This control signal is received by the receiving controller (e.g., controller of the second string), and the second string controller will operate its light strand by selecting a scheme or pattern based on the control signal, as the various schemes and patterns that may be displayed by the first decorative light string will each generate a unique control signal in the additional light decorative string. By identifying the scheme or pattern of the first light string, the additional light string may not only select the same pattern, but also closely match the timing of any flashing pattern displayed by the first light string, thereby synchronizing the two (or more) light decorative strings.

Optionally, the mode select circuit 203 may also include a signal conditioning circuit 207 to better enable the mode select circuit to identify the scheme or flashing pattern displayed by the first light string in the presence of background light or other noise impinging upon the sensor 206. Alternatively, the mode select circuit may receive the control signal by direct electronic coupling with the first light string. For example, the synchronization lead 205 may include a metal pin connector for receiving the control signal. This metal pin connector may take the form of an SPS connector or any other connector for receiving a control signal in keeping with the invention.

Also optionally, the control box 105 may include a lighting pattern selector 209 which may include a user interface portion, such as a keypad, selector switches, a remote control, and the like, such as those described in U.S. Pat. No. 8,471,480 to Kinderman, the entire contents of which are incorporated herein by reference in their entirety.

These user interface portions may enable a user to select one of various pre-programmed lighting schemes or flashing patterns. The keypad, for example, may include a dedicated pattern selector switch by which the user can control the flashing pattern displayed by the light emitting elements. Based upon the retrieved scheme and/or flashing pattern the controller (master IC) provides an appropriate signal to effectuate the scheme and/or pattern in the light strand. The memory may also be used to store the last scheme and/or flashing pattern displayed before the light string is powered down so that the controller may restore that same scheme and/or flashing pattern upon the next power up.

Figure 3:
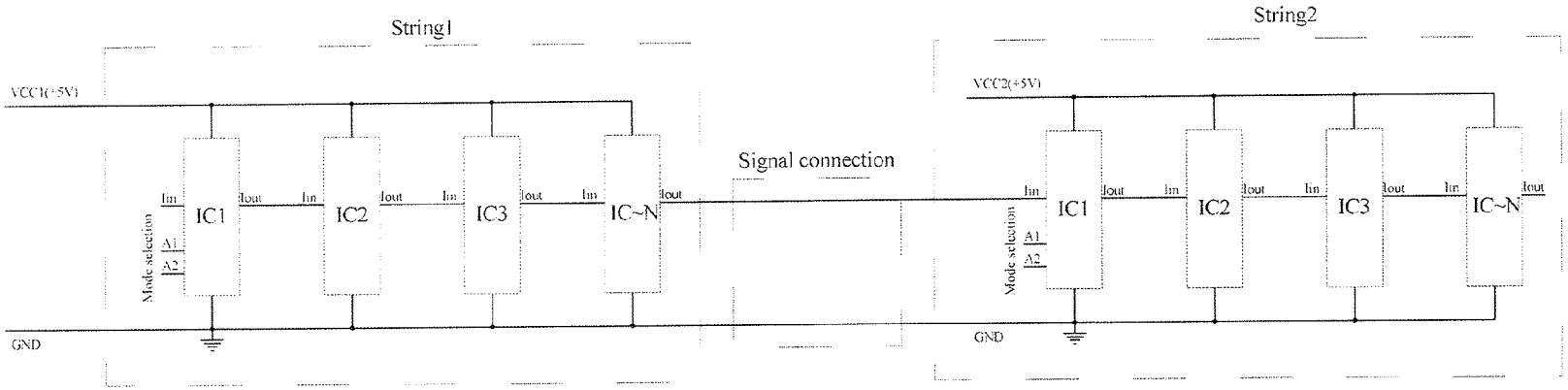
FIG. 3 is a schematic diagram illustrating an integrated circuit configuration of first and second light strings according to an embodiment of the present invention.

FIG. 3 is a schematic diagram of a first decorative light string connected to a second decorative light string, according to an embodiment of the present invention. As shown, each of the first and second decorative light strings comprises a plurality of integrated circuits (ICs), with "IC1"

being a controller configured to control each light emitting module on a light strand. For example, the controller may be able to select a mode of operation of the light emitting elements via mode selection inputs A1 and A2. IC2-IC~N are ICs attached to respective light emitting elements (not shown) which, under direction from the controller via a control signal, control the operation of such respective light emitting elements. It should be noted that the second string shown (String 2), is by way of non-limiting example only. As such, any type of string may be connected to String 1. Even though as shown the ICs are powered by about 5 V DC voltage, the voltage is by way of non-limiting example only. Accordingly, the ICs of String 1 and/or String 2 may be powered by any DC or AC voltage in keeping with the invention.

Figure 4:
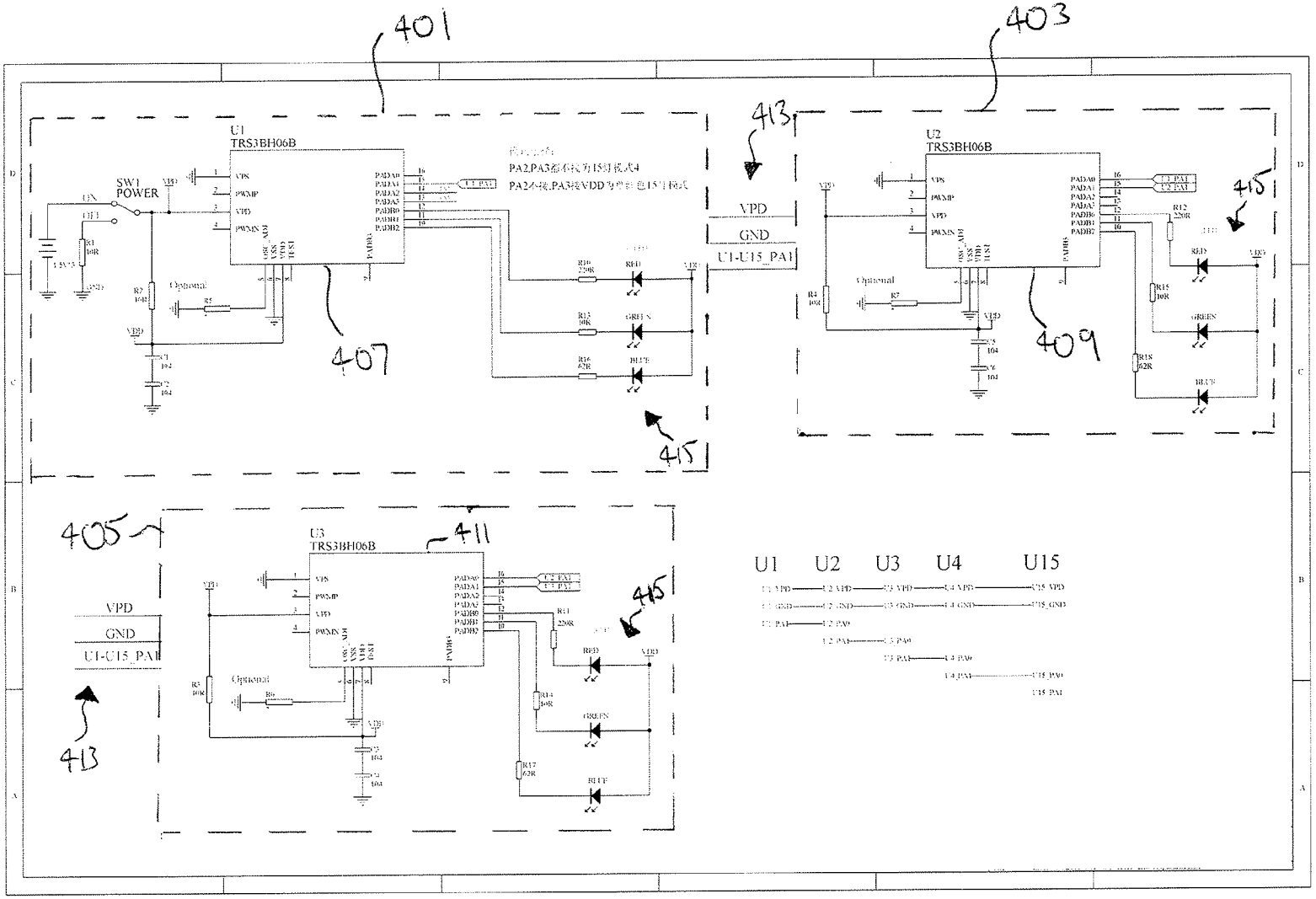
FIG. 4 is a schematic diagram of light modules according to an embodiment of the present invention.

According to an embodiment of the present invention, FIG. 4 is a detailed schematic diagram of master light module 401 and a slave light module 403 of a first decorative light string 100 (e.g., a decorative light string connected to a standard 120 V AC wall outlet), and a master/slave light module 405 of a connected string (a string connected and receiving power via the first string). The master light module 401 includes an IC 407 in the form of a controller operating in a master mode. The slave light module 403 includes an IC 409 operating in slave mode. The additional light module 405 refers to a light module of an additional string connected to a first string comprising the master and slave light modules. The additional light module 405 includes an IC 411 configured to operate in master or slave mode. For example, when being connected to a first light string, the IC 411 of the additional light module may automatically default to a slave mode of operation under the control of the master IC 401 of the first light string.

In this embodiment, the light modules are connected in parallel with a plurality of leads 413. As shown, each light module includes three respective light emitting elements in the form of red, blue, and green LEDs 415. However, it should be noted that each light module 401, 403, 405 may include any number of light emitting elements 415 and any combination of colors in keeping with the invention. One of the leads supplies a DC voltage (e.g., 5V) to the light modules 401, 403, 405, and the other provides a data signal to the light modules 401, 403, 405. The data signal also includes a timing signal, thus eliminating the need to implement separate timing signals on each of the light modules. As discussed above, each light module 401, 403, 405 includes its own respective IC 407, 409, 411 to interpret the data signal and timing signals and to activate the LEDs 415 on the respective light module 401, 403, 405 according to each signal. Optionally, the IC 407, 409, 411 of each light module 401, 403, 405 may include its own memory for electronic storage of color schemes and flashing patterns. As another option, the IC 407, 409, 411 of each light module 401, 403, 405 may be associated with a unique identifier, thereby enabling the controller to control each module on the light strand independently from the other light modules. It should be noted that the components, their respective values, and configuration of the same as shown in FIGS. 3 and 4 are for illustrative purposes only. As such, different components, values and configurations may be used while still keeping with the invention. Further, any number of additional light strings may be connected depending at least in part on power requirements.

Each of the light strings of FIGS. 3 and 4 (String 1 or String 2) enables activation of each LED on each module simultaneously and with differing intensities as compared to the other LEDs on the same light module. In a configuration in which the LEDs on each light module are placed in close proximity, when viewed from a distance with the LEDs of a module simultaneously activated, light from the LEDs on that module blend in both source and color. Further, in instances where each module is independently controlled, the color and intensity displayed by any one module is independent of the color and intensity displayed by any other module. These features, when implemented in combination, give the light strings of FIGS. 3 and 4 the ability to display practically an infinite number of color schemes and/or flashing patterns.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A decorative light string comprising:

a first light strand including a plurality of parallel connected light modules, each light module including a light emitting element and an integrated circuit (IC), the first light strand further including a data channel connecting to each IC and configured to transmit a data signal between the ICs;

a converter configured to convert alternating current (AC) line power to direct current (DC) voltage to power the first light strand;

a controller operatively coupled to the first light strand and the converter, the controller including a DC voltage output and an AC voltage output for powering a second light string, the controller being configured to control each of the plurality of light emitting elements;

an electrical connector coupled to the first light strand, the electrical connector being configured to connect the second light string to the decorative light string; and a data lead coupled to the data channel and configured to provide the data signal to an IC of the second light string.

2. The decorative light string of claim 1, wherein the second light string is of a different type than the decorative light string.

3. The decorative light string of claim 1, wherein the each of the plurality of ICs is configured to control each of the respective light emitting elements according to a control signal received by the controller.

4. The decorative light string of claim 1, wherein each of the light emitting elements comprises one or more light emitting diodes (LEDs).

5. The decorative light string of claim 4, wherein the one or more LEDs comprise at least two LEDs, and wherein each of the two or more LEDs is of a different color.

6. The decorative light string of claim 1, wherein the light emitting elements are controlled using a predetermined pattern.

7. The decorative light string of claim 1, wherein the data signal includes a timing signal.

8. The decorative light string of claim 1, wherein the second light string has a controller.

9. A decorative light string comprising:

a first light strand including a plurality of parallel connected light modules, each light module including a light emitting element and an integrated circuit (IC), the first light strand further including a data channel connecting to each IC and configured to transmit a data signal between the ICs;

a converter configured to convert alternating current (AC) line power to direct current (DC) voltage to power the first light strand;

a controller operable in either a master mode or a slave mode and operatively coupled to the first light strand and the converter, the controller including a DC voltage output and an AC voltage output for powering a second decorative light string, the controller being configured to control each of the plurality of light emitting elements, the controller being placed in the slave mode in response to receipt of an externally generated control signal by the controller;

an electrical connector coupled to the first light strand, the electrical connector being configured to connect the second light string to the decorative light string, wherein the decorative light string is different from the second light string; and a data lead coupled to the data channel and configured to provide the data signal to an IC of the second light string.

10. The decorative light string of claim 9, comprising:

wherein the plurality of ICs is configured to receive the DC voltage output from the controller.

11. The decorative light string of claim 10, wherein one of the respective ICs communicates with another of the respective ICs.

12. The decorative light string of claim 9, wherein each of the light emitting elements comprises one or more light emitting diodes (LEDs).

13. The decorative light string of claim 12, wherein the one or more LEDs comprise at least two LEDs, and wherein each of the two or more LEDs is of a different color.

14. The decorative light string of claim 9, further comprising:

a light pattern selector operatively coupled to the controller, wherein the controller is configured to control the light emitting elements according to a setting input at the light pattern selector.

15. The decorative light string of claim 14, wherein the light pattern selector comprises a wireless remote control.

16. The decorative light string of claim 9, wherein the light emitting elements are controlled using a predetermined pattern.

17. The decorative light string of claim 9, wherein the data signal includes a timing signal.

18. A decorative light string comprising:

a first light strand including a plurality of parallel connected light emitting elements wherein each of the plurality of parallel connected light emitting elements includes a respective integrated circuit (IC);

a data channel connecting to each IC and configured to transmit a data signal between the ICs;

a converter configured to convert alternating current (AC) line power to direct current (DC) voltage to power the first light strand;

a controller operatively coupled to the first light strand and the converter, the controller including a DC voltage output and an AC voltage output for powering a second light string, the controller being configured to control each of the plurality of light emitting elements via the respective IC;

a light pattern selector operatively coupled to the controller, wherein the controller is configured to control the light emitting elements according to a setting input of the light pattern selector;

an electrical connector coupled to the first light strand, the electrical connector being configured to connect a second light string to the decorative light string; and a data lead coupled to the data channel and configured to provide the data signal to an IC of the second light string.

19. The decorative light string of claim 18, wherein one of the respective ICs communicates with another of the respective ICs.

20. The decorative light string of claim 18, wherein each of the light emitting elements comprises one or more light emitting diodes (LEDs).

21. The decorative light string of claim 18, wherein the light pattern selector comprises a user interface disposed in a housing containing the controller.

22. The decorative light string of claim 18, wherein the data signal includes a timing signal.

* * * * *